United States Patent [19]

Compton et al.

[11] 4,125,132

[45] Nov. 14, 1978

[54] FRICTION PAD DEVICE

[76] Inventors: Ralph M. Compton, 4 Briarcreek Pl.; Johnny W. Jenkins, Jr., 111 Sycamore Dr., both of Greenville, S.C. 29607

[21] Appl. No.: 778,439

[22] Filed: Mar. 17, 1977

[51] Int. Cl.[2] ..... D03D 45/20

[52] U.S. Cl. ..... 139/255

[58] Field of Search ..... 139/255, 241, 224 A, 139/1 R

[56] References Cited

U.S. PATENT DOCUMENTS

| | | | |
|---|---|---|---|
| 2,062,687 | 12/1936 | Turner | 139/255 X |
| 2,379,589 | 7/1945 | Nichols | 139/255 |
| 2,380,807 | 7/1945 | Turner | 139/255 |
| 2,443,876 | 6/1948 | Turner | 139/255 |
| 2,459,411 | 1/1949 | Brown | 139/255 |
| 2,762,401 | 9/1956 | Jennings | 139/255 |
| 2,784,745 | 3/1957 | Carroll | 139/255 |
| 3,868,975 | 3/1975 | Stahl et al. | 139/1 R |

*Primary Examiner*—James Kee Chi

*Attorney, Agent, or Firm*—Bailey, Dority & Flint

[57] ABSTRACT

A device for use with automatic yarn filling apparatus on a shuttle loom for imparting a rotation to a spent bobbin ejected from a shuttle comprises a substantially rigid friction pad and a bracket member for mounting the friction pad on the loom so that the angle of the friction pad relative to the path of a descending bobbin may be adjusted to impart a rotation for unwinding an effective transfer tail of unused yarn from the bobbin.

9 Claims, 5 Drawing Figures

FRICTION PAD DEVICE

BACKGROUND OF THE INVENTION

When utilizing automatic yarn filling apparatus on shuttle type looms, it is necessary to eject a spent or used bobbin from the shuttle and strip the small amount of unused yarn from the spent bobbin prior to winding a new filling of yarn thereon. Such an automatic yarn filling apparatus is shown in U.S. Pat. No. 2,766,779. It is essential to the successful operation of the automatic yarn filling apparatus that a free end of the unused yarn be trailing from the spent bobbin a sufficient length to provide a transfer tail. The transfer tail is subsequently caught by a yarn stripper which forms a part of the automatic filling apparatus wherein the bobbin is completely stripped of the unused yarn. If the transfer tail is not adequate to be caught by the yarn stripper, the unused yarn must be unwound by hand or, if not detected, a new filling of yarn will be wound upon the unused yarn which can cause a defect in the material being woven.

Attempts have been made to develop devices for abutting the bobbin following ejection from the shuttle so as to impart a rotation to the bobbin and unwind a sufficient length of unused yarn therefrom. One abutment device is mounted on the shuttle directly below a head of the bobbin as disclosed in U.S. Pat. No. 2,785,702. Another prior art device is illustrated in FIG. 4 as including a flexible insert member mounted on a portion of the loom and extending into the path of the bobbin. However, these type devices are overly protruding and interfere with the natural flight of the bobbin as it descends often retarding the natural rotation of the bobbin. In the latter case, the flexible member must be deflected downwardly for the bobbin to gain passage thereby reducing the energy of the bobbin and, in some instances, the bobbin itself may be deflected outwardly falling to the floor.

Another device for rotating a bobbin is shown in U.S. Pat. No. 3,965,941 issued to the same inventors of the present invention, wherein one jaw of a shuttle spring has a greater vertical width than the opposing jaw so as to spin or rotate the bobbin held therebetween as it is ejected therefrom. While this device has greatly reduced the number of unstripped bobbins delivered from the bobbin stripper, it has been found that the number of unstripped bobbins can be reduced even further when utilizing such a device in combination with the present invention. Furthermore, the device of the present invention need not be limited to use with such a shuttle spring but may also be advantageously and effectively used by itself for reducing the number of unstripped bobbins.

SUMMARY OF THE INVENTION

A device for imparting a rotation to a spent bobbin ejected from a shuttle on a shuttle loom is disclosed comprising a bracket member having a shank portion adapted for attachment to the loom, and an integral leg portion extending outwardly from the shank portion. The leg portion is bendable about the shank portion to adjust the inclination therebetween. A layer of friction material is carried on the leg portion providing a friction surface. The layer of friction material and the rigid leg portion define a substantially rigid friction pad which may be bent relative to the shank portion for positioning the friction surface at a desired angle to a path of the ejected bobbin when attached to the loom for imparting rotation to the bobbin.

Accordingly, it is an important object of the present invention to provide a friction pad for imparting a rotation to a bobbin so as to cause an effective transfer tail of unused yarn of unwind therefrom.

Another important object of the present invention is to provide a friction pad which is substantially rigid and may be mounted in a substantially flush relationship with a bobbin deflector plate on a loom for effectively imparting a desired rotation to an ejected bobbin as it descends to an automatic yarn stripper apparatus.

Still another important object of the present invention is to provide a friction and bracket for mounting to a loom whereby the angle of the friction pad relative to a path of a descending bobbin may be adjusted so as to impart a desired rotation to the spent bobbin.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a device, shown generally at 10, for imparting a rotation to a spent bobbin ejected from a shuttle on a shuttle-type loom comprising a bracket member having a shank portion A adapted for attachment to the loom and a leg portion B extending outwardly from the shank portion A and being bendable about the shank portion to adjust the relative inclination therebetween. A layer of friction material C is adhered to the leg portion providing a friction surface and together with the rigid leg portion B defines a substantially rigid friction pad which may be bent relative to the shank portion for positioning the friction surface at an optimum angle to a path of the ejected bobbin for rotating the bobbin and causing an effective transfer tail of unused yarn to unwind therefrom.

The device 10 is of particular advantage when used with an automatic yarn filling apparatus such as the Unifil Loom Winder Model No. 790 manufactured by the Leesona Corporation on a conventional shuttle loom. On such a loom, a shuttle carrying a yarn filled bobbin is picked to and fro across a lay. In the automatic filling apparatus, the bobbin is ejected from the shuttle when spent and is directed by a bobbin deflector plate on the loom to a stripper chute of the automatic filling apparatus wherein the unused yarn is completely stripped prior to refilling the empty bobbin with new yarn.

Figure 1:
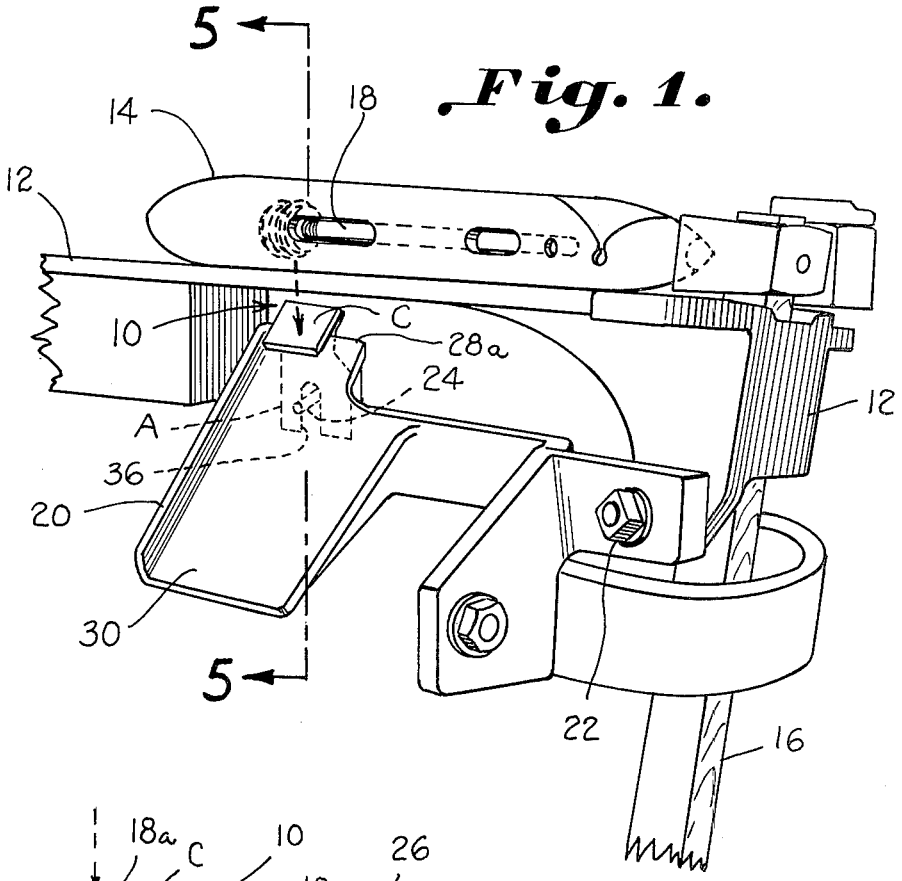
FIG. 1 is a perspective view illustrating a lay end of a shuttle type loom with a shuttle in position on the lay for ejecting a spent bobbin from the shuttle.
Figure 2:
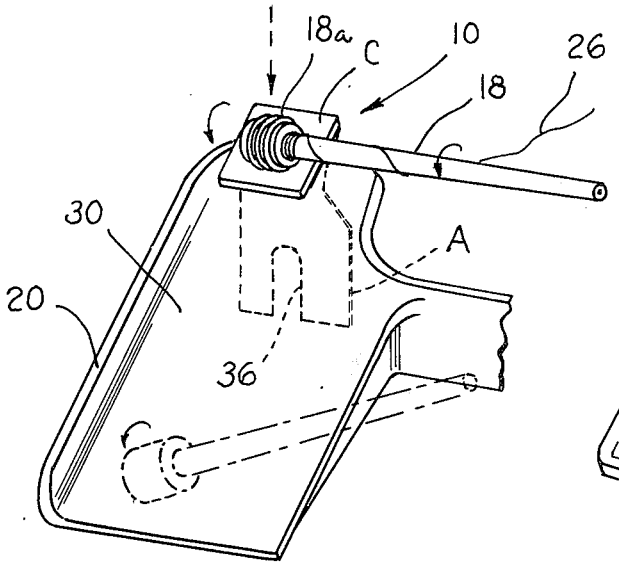
FIG. 2 is a perspective view illustrating an ejected bobbin striking a friction pad device constructed in accordance with the present invention as it descends toward a stripper chute.
Figure 3:
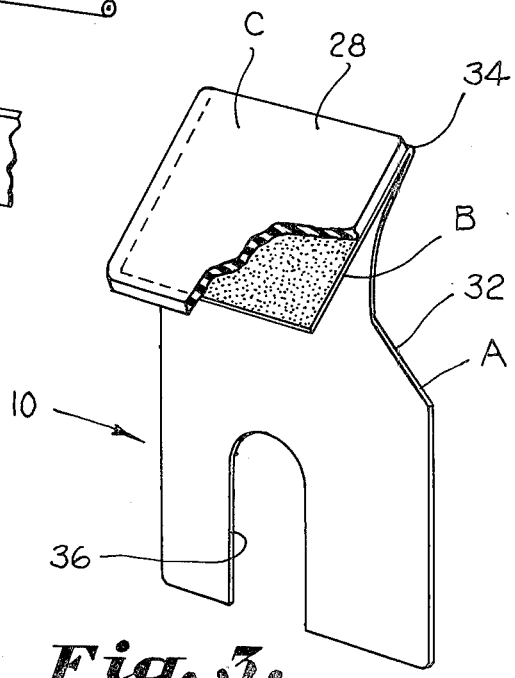
FIG. 3 is a perspective view of a friction pad and bracket device constructed in accordance with the present invention.

Since the device of the present invention may be used on any shuttle loom and since such looms are conventional, only so much of a conventional shuttle loom is illustrated in the drawings as is required for an understanding of the present invention. Accordingly, FIG. 1 illustrates only the end of a lay 12 across which a shuttle 14 is picked to and fro by means of a picking mechanism 16. A bobbin 18 is carried in the shuttle 14 as it is picked across the lay. When the bobbin is empty, the bobbin is ejected downwardly from the shuttle by the insertion of a newly filled bobbin by the automatic filling apparatus. A bobbin deflector plate 20 is attached to the lay by means of suitable nut and bolt assemblies 22 and 24. The deflector plate 20 is utilized to deflect the bobbin and keep it from falling on the floor and when used with automatic yarn filling apparatus directs the bobbin to a chute of an automatic yarn stripper which forms part of the automatic filling apparatus referred to above.

In order to create a tail of unused yarn 26 which is adequate for being caught in the stripper, it is necessary that the bobbin rotate to unwind a sufficient length of unused yarn therefrom. The direction that the bobbin needs to rotate depends on the direction in which the yarn is wound on the bobbin. Normally an ejected bobbin must rotate in a counter-clockwise direction as viewed in FIG. 5 of the drawings. As illustrated, the friction pad C is mounted in substantially flush relationship with the bobbin deflector plate 20 and lies in a path of the bobbin 18 as it is ejected from the shuttle 14. Abutment of the bobbin head 18*a* with a generally planar friction surface 28 of the friction pad C imparts a rotation in the counter-clockwise direction to the bobbin due to the friction therebetween.

Figure 5:
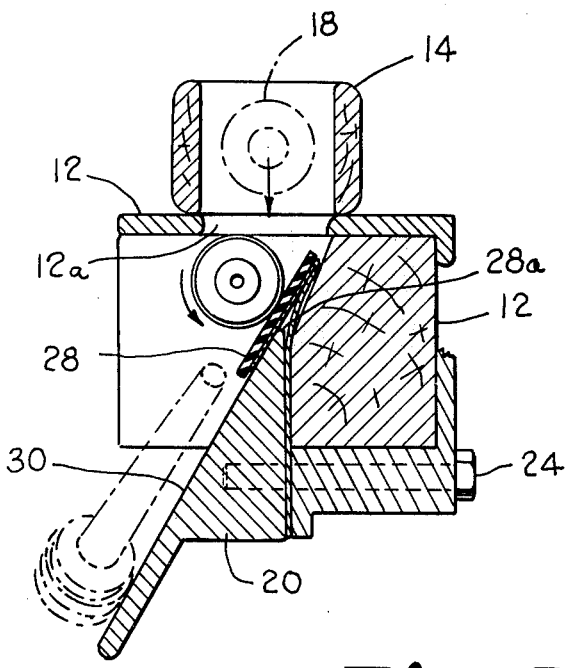
FIG. 5 is a sectional view taken along line 5—5 of FIG. 1 illustrating the friction pad and bracket device constructed in accordance with the present invention and mounted on a lay end.

The friction pad C is mounted flush with the bobbin deflector plate 20 in that they are in direct contact or immediately adjacent one another and the friction surface 28 is contiguous with the top surface 30 of the bobbin deflector plate extending above an uppermost portion 28*a* and coextending with a portion of the plate surface as best seen in FIG. 5.

With the friction pad so positioned, there is no interference presented to the normal path of the descending bobbin as it is flush with the top surface of the deflector plate 20. In essence, the bobbin is striking the friction surface 28 which rolls the bobbin head whereas, without the friction pad so mounted, the bobbin would normally strike the smooth surface of the deflector plate and slide rather than rotate relative thereto. In effect, the smooth deflector plate surface has been converted into a generally planar friction surface in the area where the bobbin head initially strikes the deflector plate.

Means for mounting the friction pad C flush with the bobbin deflector plate is illustrated as including a bracket member 32 consisting of the rigid shank portion A and rigid leg portion B which are bendable relative to each other at the juncture 34 thereof. The bracket member is preferably formed by bending a single piece of metal upon itself. The shank portion A includes a vertical open-ended slot 36 which is received over the bolt 24 for mounting the bracket and friction pad in a space normally between the deflector plate 20 and the lay 12. The friction pad C is preferably a single piece layer of elastomeric material which is resilient in the sense that it is capable of absorbing shock from impact with the bobbin without permanent deformation to the material and recovers its shape after being deformed by compression. The layer of elastomeric material may be secured to the leg portion B by any suitable means such as an adhesive. Alternately, the pad of material may be removably attached whereby replacement may be had of the pad only while re-using the bracket member.

Figure 4:
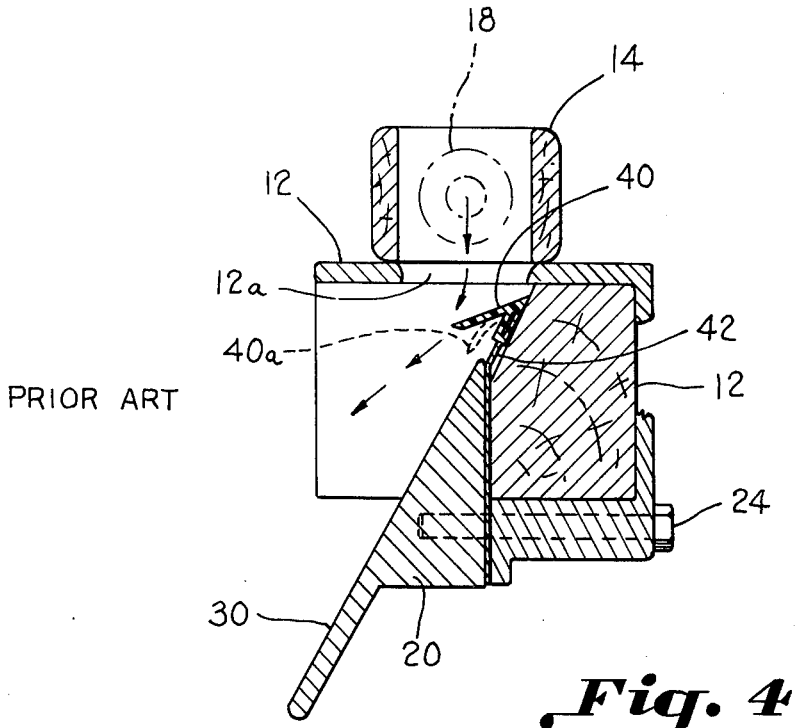
FIG. 4 is a side elevational view illustrating a prior art device for imparting rotation to a spent bobbin.

FIG. 4 illustrates a prior art device as discussed in the background material, supra, which includes a flexible insert member 40 mounted by means of a bracket 42 so as to extend outwardly into the path of the bobbin 18 following ejection from the shuttle 14. The flexible member 40 is deformed to the position 40*a* shown in the dash lines in order for the bobbin to move through an opening 12*a* in the lay and past the flexible member 40. Whether or not the bobbin is rotating when it leaves the shuttle, some of the energy of the bobbin is lost in deflecting the flexible member 40. As discussed previously, the flexible member overly protrudes into the bobbin path and is not always an expedient to bobbin rotation. This device has been known to have an opposite reaction on the bobbin and deflect it outwardly and onto the floor.

As best illustrated in FIG. 5, and as described previously, the friction pad C of the present invention is mounted flush with the bobbin deflector plate 20 and the bobbin head 18 abuts the friction pad C without interference to its normal descent path. It is important to note that the layer of friction material C and the rigid leg portion B define an integral substantially rigid friction pad which may be bent relative to the shank portion A for positioning the friction surface 28 at an optimum angle to the path of the ejected bobbin when descending from the shuttle. The flush mounting has been found to provide the optimum angle for bobbin rotation for most applications. Following mounting of the shank portion A to the lay, the friction pad is bent flush with the deflector plate 20. Since all deflector plates are not identical, this embodiment and mounting of the friction pad is highly advantageous. Upward angular positioning of the friction pad from the flush position may not substantially decrease performance of the present device until the point is reached where the friction pad overly obstructs and interferes with the bobbin flight path.

While it has been found that the flush relationship provides the optimum angle for bobbin rotation, application to some looms and types of yarn and bobbins might require that the friction pad be adjusted in its angular orientation. In such a case, an adjustable friction pad constructed in accordance with the present invention is also highly advantageous.

Thus it can be seen that an advantageous construction for a friction pad and bracket device can be had in accordance with the present invention for imparting an increased rotation to a spent bobbin ejected from a shuttle wherein the friction pad is substantially rigid and does not absorb any of the energy of rotation and may be adjusted for flush mounting or any other angle that may be optimum for engagement with a descending bobbin.

While a preferred embodiment of the invention has been described using specific terms, such description is for illustrative purposes only, and it is to be understood that changes and variations may be made without departing from the spirit or scope of the following claims.

What is claimed is:

1. For use with automatic yarn filling apparatus on a shuttle loom wherein a shuttle carrying a yarn filled bobbin is picked to and fro across a lay, said bobbin being ejected from said shuttle when spent and being directed by a bobbin deflector plate to a stripper chute of said automatic filling apparatus wherein the unused yarn is unwound therefrom prior to re-filling said spent bobbin with yarn, a device for imparting a rotation to a spent bobbin when ejected from said shuttle so as to cause a tail of the unused yarn to unwind from said spent bobbin comprising:

a friction pad, means for mounting said friction pad in substantially flush relationship with said bobbin deflector plate and lying in a path of said bobbin as it descends from said shuttle, and said friction pad including a generally planar surface layer of friction material for abutting a head of said ejected bobbin causing it to rotate.

2. The apparatus of claim 1 wherein said means for mounting said friction pad includes a bracket member having a shank portion for attachment to said lay and a leg portion integral with said shank portion on which said layer of friction material is carried.

3. The apparatus of claim 2 wherein the angular orientation of said leg portion relative to said shank portion is adjustable so that said friction pad may be positioned in said flush relationship.

4. The apparatus of claim 1 wherein said friction pad extends beyond an uppermost edge of said bobbin deflector plate and coextends across an upper portion of said deflector plate in said flush relationship therewith.

5. The apparatus of claim 1 wherein said means for mounting said friction pad includes a rigid leg portion supporting said layer of friction material, a shank portion integral with said leg portion adapted for attachment to a portion of said lay, said leg portion being bendable relative to said shank portion to position said surface layer flush with the upper surface of said bobbin deflector plate.

6. A device for imparting a rotation to a spent bobbin ejected from a shuttle on a shuttle loom comprising:

a bracket member having a shank portion adapted for attachment to said loom;

an integral leg portion extending outwardly from said shank portion, said leg portion being bendable about said shank portion to adjust the relative inclination therebetween;

a layer of friction material carried on said leg portion providing a generally planar friction surface for engaging a head of said bobbin; and said layer of friction material and said rigid leg portion defining a substantially rigid friction pad which may be bent relative to said shank portion for positioning said friction surface at a desired angle to a path of said ejected bobbin when attached to said loom for imparting said rotation to said bobbin.

7. The structure set forth in claim 6 wherein said shank and leg portions are formed as one piece.

8. The structure set forth in claim 6 wherein said layer of friction material comprises a piece of elastomeric material secured to said leg portion.

9. The structure set forth in claim 8 wherein said leg and shank portions are formed by bending a single piece of metal upon itself.

* * * * *